United States Patent [19]

Heath

[11] 4,109,468

[45] Aug. 29, 1978

[54] HEAT ENGINE

[76] Inventor: Willie L. Heath, P.O. Box 122, Dardanelle, Ark. 72834

[21] Appl. No.: 352,477

[22] Filed: Apr. 18, 1973

[51] Int. Cl.[2] ..... F01K 25/10

[52] U.S. Cl. ..... 60/670; 60/671

[58] Field of Search ..... 60/36, 24, 524–530, 60/508, 509, 512, 515, 643, 645, 651, 650, 670, 671, 682

[56] References Cited

U.S. PATENT DOCUMENTS 3,451,342 6/1969 Schwartzman ..... 60/36

*Primary Examiner*—Allen M. Ostrager

*Attorney, Agent, or Firm*—Clarence A. O'Brien; Harvey B. Jacobson

[57] ABSTRACT

A reciprocating piston engine of either the two stroke cycle port type or the two stroke cycle valve type utilizing a vaporizable and condensible fluid as a working fluid. The working fluid and means for applying external heat to the working fluid is selected from one of the well known halogenated hydrocarbons employed as refrigerants in various refrigeration systems and is preferably Freon-12.

1 Claim, 2 Drawing Figures

10
28
42
44
24
22
30
40
20
16
14
46
18
26
38
HEATER
39
32
36
34

50
82
90
68
54
56
64
62
60
58
88
86
78
84
80
66
76
HEATER
75
70
72
74

HEAT ENGINE

BACKGROUND OF THE INVENTION

1. Field of the Invention

The present invention generally relates to a power device and more particularly a heat engine utilizing the heat of friction and the heat of compression with a vaporizable-condensible fluid in which external heat vaporizes the working fluid to convert it into a gas within an expansible chamber so that expansion of the working fluid forces a piston in one direction during a working stroke. The vaporized and expanded working fluid is then cooled and condensed externally of the engine for subsequent injection into the cylinder thereby providing a working cycle.

2. Description of the Prior Art

Various types of closed looped power devices have been employed in which the working fluid is vaporizable and condensible in which various refrigerant fluids are employed. Prior U.S. Pat. No. 3,479,817, issued Nov. 25, 1969 discloses such an arrangement that incorporates a condenser, boiler and superheater externally of a turbine in which the working medium is introduced into the power device or turbine in a heated gaseous state. Prior U.S. Pat. No. 3,531,933 discloses a similar arrangement of the reciprocating engine type in which Freon-12 is utilized as the working fluid with the working fluid being externally heated to provide superheated vapor which is introduced into the engine and condensed after discharge from the engine. Such previously patented devices utilize external heating devices for converting liquid refrigerant into a superheated gaseous vapor which is introduced into the working chamber in which the working chamber converts the heat energy in the superheated vapor to mechanical energy.

SUMMARY OF THE INVENTION

An object of the present invention is to provide a heat engine of the reciprocating piston type utiliting Freon-12 as a working fluid with the working fluid being injected into a cylinder in the liquid state or phase and being vaporized in the cylinder or working chamber by a source of external heat with the expansion of the liquid refrigerant into a gaseous refrigerant causing expansion of the working chamber and movement of a piston connected to a crankshaft to produce mechanical energy with the gaseous refrigerant being discharged into a condenser for conversion back to its liquid state or phase.

Another object of the invention is to provide a heat engine in accordance with the preceding object in which the engine includes a piston and cylinder arrangement in which the cylinder has discharge ports openable by the piston during its power stroke thereby providing a two stroke cycle engine.

A further object of the invention is to provide a heat engine including an exhaust valve assembly for discharge of refrigerant during part of the return stroke of the piston to provide a two stroke cycle engine.

Yet another object of the invention is to provide a heat engine which is simple in construction, effective for converting heat energy to mechanical energy and relatively inexpensive to operate.

These together with other objects and advantages which will become subsequently apparent reside in the details of construction and operation as more fully hereinafter described and claimed, reference being made to the accompanying drawings forming a part hereof, wherein like numerals refer to like parts throughout.

DESCRIPTION OF THE PREFERRED EMBODIMENTS

Figure 1:
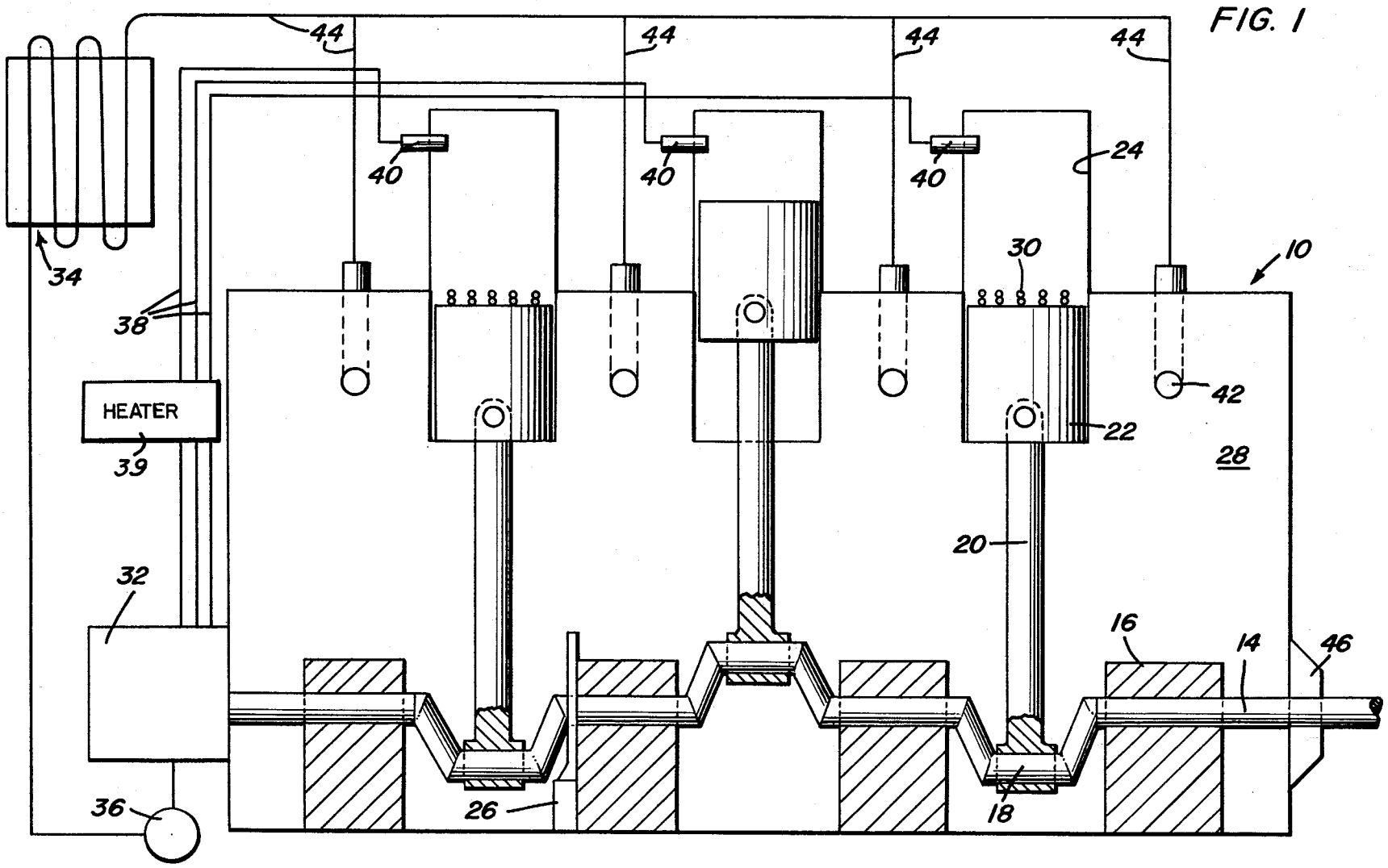
FIG. 1 is a schematic view of the heat engine illustrating the two stroke cycle port type embodiment.

Referring specifically to FIG. 1 in the drawings, there is schematically illustrated a heat engine or motor generally designated by reference numeral 10 which includes a rotatable crankshaft 14 supported in suitable bearing supports 16 and having offset cranks 18 thereon to which piston rods 20 are connected. The piston rods 20 are connected to pistons 22 which reciprocate in cylinders 24 with the structure of the crankshaft, bearings, cranks, pistons and piston rods being of substantially conventional and well known construction. A suitable oil pump 26 is driven from the crankshaft for providing a pressurized oil system for lubricating the relatively movable components of the engine. Also, the engine 10 includes a hollow crankcase 28 defining an enclosure for the crankshaft, lower ends of the cylinders, pistons and the like in the conventional manner of a two stroke cycle engine. Each of the cylinders 24 is provided with a plurality of exhaust ports 30 which communicate with the crankcase 28 when the piston 22 is at the bottom of the stroke with the piston 22 serving as a valve for opening and closing the ports 30 in a well known manner in a conventional two stroke cycle engine.

The crankshaft 24 drives an injector pump 32 that is supplied liquid refrigerant from a condenser assembly 34 by a supply pump 36. The injector pump 32 discharges refrigerant through discharge lines 38 in heat exchange relationship with a heater 39 and thence to an injector 40 in each of the cylinders 24 with the injector 40 being located adjacent the top of the cylinder 24. Hot gas return passageways 42 are provided in the crankcase 28 with the passageways 42 being connected with and communicating with return lines 44 to the condenser assembly 34. Suitable seals such as a seal 46 is provided for the crankshaft along with suitable lubrication features for retaining the relatively movable components of the engine in properly lubricated and sealed condition during operation.

In operation of this embodiment of the invention, the liquid pump 36, driven from a suitable power source, conveys liquid refrigerant from the bottom of the condenser assembly or heat exchanger 34 to the injector pump 32 under high pressure in order to keep vapor from forming. The injector pump injects liquid refrigerant through the heater 39 and thence through the injectors 40 into the cylinder 24 in an appropriately timed relation to movement of the pistons 22 in a similar manner to injecting fuel in an internal combustion engine. As the piston 22 moves towards top dead center, the gaseous working fluid entrapped in the cylinder will be compressed and increased in temperature and at the top of the stroke of the piston, injection of the refrigerant occurs which increases the pressure in the cylinder thereby increasing the heat of compression and causing vaporization and expansion of the refrigerant injected into the cylinder thus causing the piston to move downwardly during a working stroke. The vaporization, expansion and pressure on the piston will be substantially constant although decreasing as the piston reaches the bottom of its stroke at which point vaporized refrigerant gas is exhausted through the ports 30 to the enclosure or crankcase 28 from where it is then returned to the condenser or heat exchanger 34 through an oil trap or the like to prevent oil from becoming entrained in the refrigerant. The refrigerant is cooled by water, air or any combination thereof in the condenser to a liquid state. If desired, a safety valve may be provided in the upper end of the crankcase to relieve any excess pressures which may occur.

Figure 2:
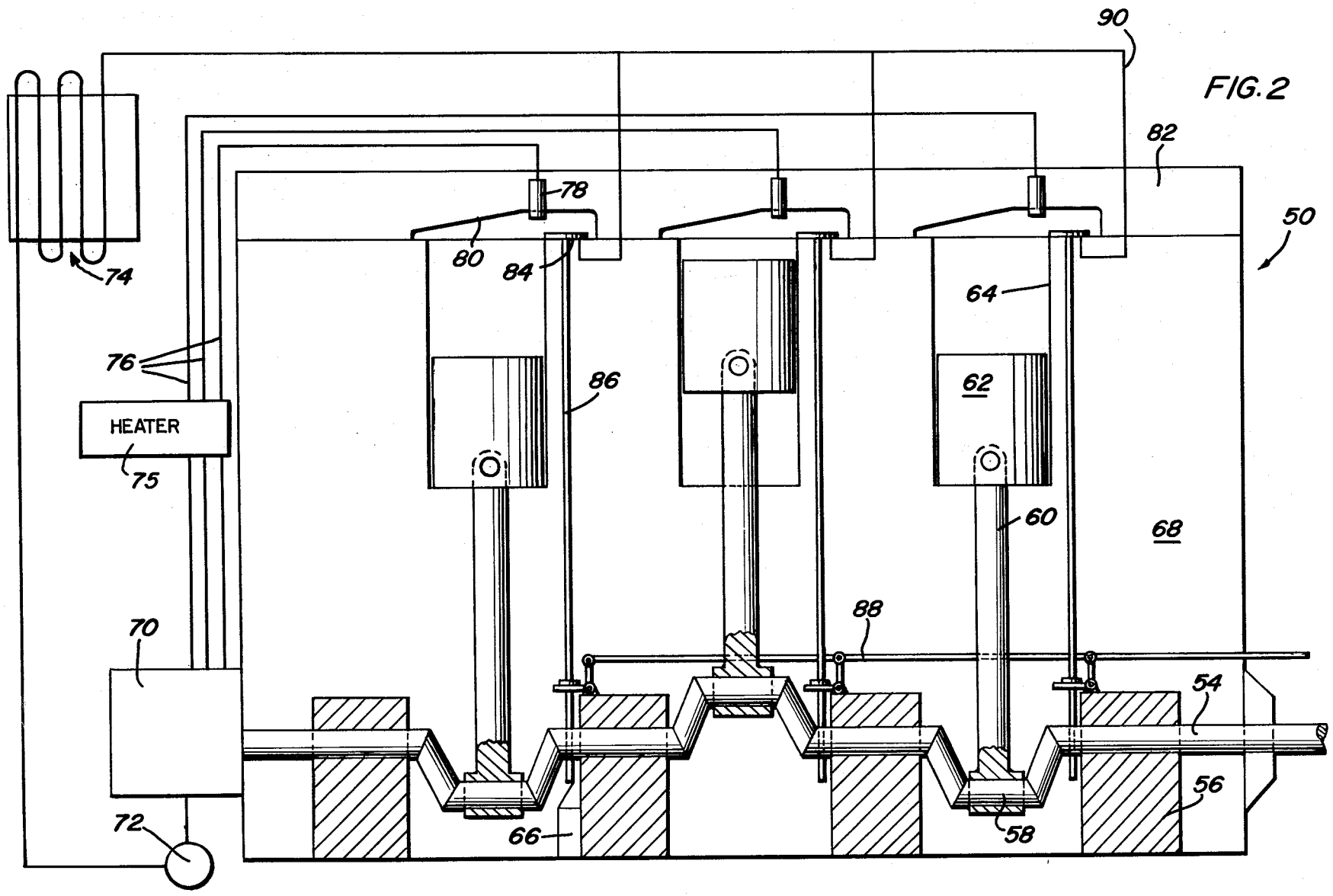
FIG. 2 is a schematic view of the heat engine illustrating the two stroke cycle valve type embodiment.

FIG. 2 illustrates a two stroke cycle heat engine that is generally designated by reference numeral 50 and includes crankshaft 54, bearings 56, a crank 58, a piston rod 60, a piston 62, a cylinder 64 all of which are associated in the conventional manner of a four stroke cycle engine but which operates as a two stroke cycle engine. Also, an oil pump 66 is provided along with a crankcase or enclosure 68.

One end of the crankshaft 54 is connected with an injector pump 70 that is supplied with liquid refrigerant by pump 72 from a condenser or heat exchanger assembly 74. The injector pump 70 pumps liquid refrigerant through a heater 75 in heat exchange relationship with lines 76 to an injector 78 communicated with a compression chamber 80 in the bottom of a cylinder head 82. The compression chamber or recess 80 is provided with an exhaust valve 84 having a valve stem or rod 86 connected thereto and operative from a suitable cam structure from the crankshaft, camshaft or the like. A compression release device 88 is connected to all of the valve rods 86 to open the exhaust valves 84 manually or automatically when desired such as when starting the engine. The valves 86 are directly communicated with return lines 90 which return the gaseous refrigerant back to the condenser or heat exchanger 74. This completes the cycle for the refrigerant with the specific construction of the components being conventional and well known.

Operation of this form of the invention is the same as that illustrated in FIG. 1 except that the valves 84 are opened to exhaust the gaseous refrigerant rather than the ports 30 being opened by movement of the piston as in FIG. 1. The valves would open at approximately bottom dead center and close approximately 90 degrees prior to top dead center thus providing approximately one quarter stroke as exhaust and one quarter stroke as compression with each down stroke being a power stroke thus, in effect, providing a two stroke cycle operation with the valves being properly timed for opening and closing during each stroke of the piston. The compression release is operated to release the compression during initial starting and when stopping the motor thus avoiding the possibility of recompressing the gas in the compression chamber to a point above the critical point which may cause it to separate or deteriorate.

The compression chamber is preferably of cone shape in order to disperse the liquid over a larger area of the hot gas vapor. A camshaft may be used for the operation of the valves and pumps. Also, a header or muffler may be used on the exhaust line instead of employing the engine crankcase but it may be preferable to use the engine crankcase for exhaust of the gaseous refrigerant in order to keep the engine at a more even temperature throughout and to vaporize any liquid lost through the injector pump. Various controls may be provided for the system in order to maintain a desired pressure and temperature in the system including controls on the condenser for maintaining the condenser operative under the desired conditions.

The injector pump may be disposed interiorly of the engine and heat is added to the high pressure liquid refrigerant after it has passed through the injector pump to supplement the friction heat of compression. Such additional heat may be absorbed from the exhaust gases before they reach the condenser or the refrigerant could be heated by combustible fuel or the like. The refrigerant injected into the cylinder is injected into the compressed hot gas refrigerant that has been compressed during the compression stroke of the piston and this heat compression serves to vaporize and expand the liquefied refrigerant. The quantity of liquid refrigerant is controllable so that it will be properly associated with the available heat so that all of the liquid refrigerant will be vaporized.

While the invention has been disclosed in reciprocating piston type engines, it is also within the purview of this invention to incorporate the arrangement into rotary engines of various types such as the Wankel engine or any other engine having a compression-expansion cycle.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for converting heat energy into mechanical energy comprising a closed system utilizing a condensible-vaporizable working fluid, said system including a piston and cylinder assembly mounted for relative movement to define an expansible working chamber, means injecting working fluid in the liquid state into the working chamber, exhaust valve means in the working chamber to discharge expanded gaseous working fluid, condensing means receiving gaseous working fluid from the exhaust valve means and changing it to liquid, and pump means supplying liquid working fluid to the injecting means under high pressure, means applying external heat to the working fluid prior to entry into the working chamber, said exhaust valve means being timed whereby at least a portion of the compression movement of the piston will compress gases in the cylinder whereby the heat of compression will heat the gases to heat and expand the injected working fluid into gaseous working fluid to move the piston during its working movement.

* * * * *